US008176678B2

(12) United States Patent
Dochtermann, III

(10) Patent No.: US 8,176,678 B2
(45) Date of Patent: May 15, 2012

(54) TELESCOPING SECURITY WINDOW

(75) Inventor: Cliff Dochtermann, III, East Patchogue, NY (US)

(73) Assignee: Armorsash, LLC, Patchogue, NY (US)

( * ) Notice: Subject to any disclaimer, the term of this patent is extended or adjusted under 35 U.S.C. 154(b) by 853 days.

(21) Appl. No.: 12/116,090

(22) Filed: May 6, 2008

(65) Prior Publication Data

US 2009/0277092 A1 Nov. 12, 2009

(51) Int. Cl.
*E06B 3/68* (2006.01)

(52) U.S. Cl. ..... 49/57; 49/55; 49/50; 49/465; 49/61

(58) Field of Classification Search ..... 49/50, 53, 49/55, 56, 57, 463, 465, 61, 62, 63
See application file for complete search history.

(56) References Cited

U.S. PATENT DOCUMENTS

| | | | | | |
|---|---|---|---|---|---|
| RE17,978 | E | * | 2/1931 | McWane | 49/56 |
| 1,996,931 | A | * | 4/1935 | McGuinness | 49/56 |
| 2,177,617 | A | * | 10/1939 | Hinton | 49/56 |
| 2,681,481 | A | * | 6/1954 | Mason | 49/56 |
| 2,755,525 | A | * | 7/1956 | Minot, Jr. | 49/55 |
| 4,059,413 | A | | 11/1977 | Forgione | |
| 4,358,910 | A | | 11/1982 | Keating et al. | |
| 4,400,911 | A | | 8/1983 | Bell et al. | |
| 4,756,122 | A | | 7/1988 | Snapka | |
| 4,817,334 | A | | 4/1989 | Badger et al. | |
| 4,937,975 | A | | 7/1990 | Zilkha | |
| 5,269,096 | A | | 12/1993 | Hade | |
| 5,283,975 | A | * | 2/1994 | Piterski | 49/50 |
| 5,339,567 | A | | 8/1994 | Pierpont et al. | |
| 5,943,832 | A | * | 8/1999 | Russell | 52/202 |
| 6,182,397 | B1 | | 2/2001 | Almond | |
| 6,427,396 | B1 | * | 8/2002 | Harrison | 52/202 |
| 6,481,159 | B2 | | 11/2002 | Diston | |
| 7,469,502 | B1 | * | 12/2008 | Steel | 49/465 |
| 7,523,589 | B1 | * | 4/2009 | Smith | 52/202 |
| 2002/0178652 | A1 | | 12/2002 | Marks | |
| 2005/0081446 | A1 | | 4/2005 | Muller | |
| 2007/0000293 | A1 | | 1/2007 | Daniels et al. | |

* cited by examiner

*Primary Examiner* — Gregory J. Strimbu
(74) *Attorney, Agent, or Firm* — K&L Gates LLP

(57) ABSTRACT

A removable security structure interposed between two window configurations is comprised of interconnecting horizontal and vertical members. The vertical members engage a gear junction of the horizontal members such that upon rotation of the vertical members, the horizontal members telescopically collapse. The reduction of length of each horizontal member disengages each horizontal member from a frame housing the window configurations. The rotation of the vertical members also frees the upper portion of the vertical members of the security structure. With the upper and side portions of the security structure freed, the security structure can be rotated and removed from the frame allowing egress.

12 Claims, 5 Drawing Sheets

TELESCOPING SECURITY WINDOW

BACKGROUND OF THE INVENTION

1. Field of the Invention

Embodiments of the present invention relate, in general, to removable security structures designed to prevent entry through an opening from the exterior and particularly to a security grill structure utilizing telescoping members to secure an opening and that can be easily removed from the interior.

2. Relevant Background

Society has long recognized the need to enhance the security of windows and other openings in certain geographic areas. For example, it is common to find windows and doors alike in certain urban areas fashioned with some sort of security grating or structure. While security gratings and structures have long prevented unwanted visitors from entering a dwelling or building, they have also prevented, on occasion, the occupants of such structures from making a successful egress during times of emergency.

As the result of individuals being inadvertently locked inside buildings during life-threatening situations, building codes have been adopted in many states regulating the installation and use of security structures. Most states now require buildings employing security structures to provide at least one opening for emergency egress that must be free of bars or other security structures or offer the ability to quickly remove the security devices without the use of a key, special tool or specialized knowledge.

Providing a security structure for an opening that is essentially impassable from the exterior yet easily removable from the interior, and that does not offend the aesthetics of the architecture, remains a challenge. U.S. Pat. No. 4,756,122 by Snapka and U.S. Pat. No. 6,182,397 by Almond both provide a security bar design that is removable yet both fail to blend or conceal the structure within the existing window design. There remains, therefore, a need to provide a removable security structure that can be combined with the architecture of the building so as to provide security while retaining the opening's aesthetics.

SUMMARY OF THE INVENTION

A removable security assembly comprising vertical and horizontal members is hereafter described. The long felt need of adding security to a window or similar opening yet retaining the ability to remove such security devices easily in the event of an emergency is addressed by embodiments of the present invention. Embodiments of the present invention provide a security structure that is both functional in providing an impenetrable barrier over an opening that is also internally easy to remove and aesthetically pleasing.

According to one embodiment of the present invention, a security structure comprised of members or bars arranged in a horizontal and vertical configuration is interposed between an interior sash window and an exterior sash window. Each of the horizontal and vertical members is removably coupled to a security frame. The frame, while associated with the interior and exterior sash window, is also secured to the building in a manner beyond that of normal window installation. Once installed, the combination of the vertical and horizontal members and frame provide a barrier to any unwanted entry.

Each of the horizontal bars is configured to interconnect with the vertical bars such that upon rotation of at least one of the vertical members, each horizontal member telescopically retracts from the security frame. According to one embodiment of the present invention, each horizontal member is comprised of two sub-members, whose combined length would be less than that of the opening, and a sleeve. The sleeve, which is hollow, acts to couple the two sub-members by having one end of each sub-member inserted into the sleeve. In doing so, the combination of the components extends the member over the entire opening.

Each horizontal member is further functionally coupled with at least one vertical member. Upon rotation of the vertical member, a torsional force is applied to the horizontal member causing one of the sub-member components of the horizontal member to translate longitudinally within the sleeve. The resulting movement reduces the overall length of the horizontal member and removes the ends of that member from sockets in the frame. Once the horizontal members have been uncoupled from the frame, the security structure can translate vertically and be removed from the frame.

According to one embodiment of the present invention, the vertical members include a lever or similar latch that is operable to rotate the member. In a normal configuration of the security structure and the sash windows, the interior sash window prevents rotation of the vertical members. In addition, the lever is inaccessible from the exterior sash window. Thus, according to one embodiment of the present invention, the interior sash window is removable so as to provide access to the lever and enable vertical member rotation.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of a preferred embodiment taken in conjunction with the accompanying drawings, wherein.

Figure 1:
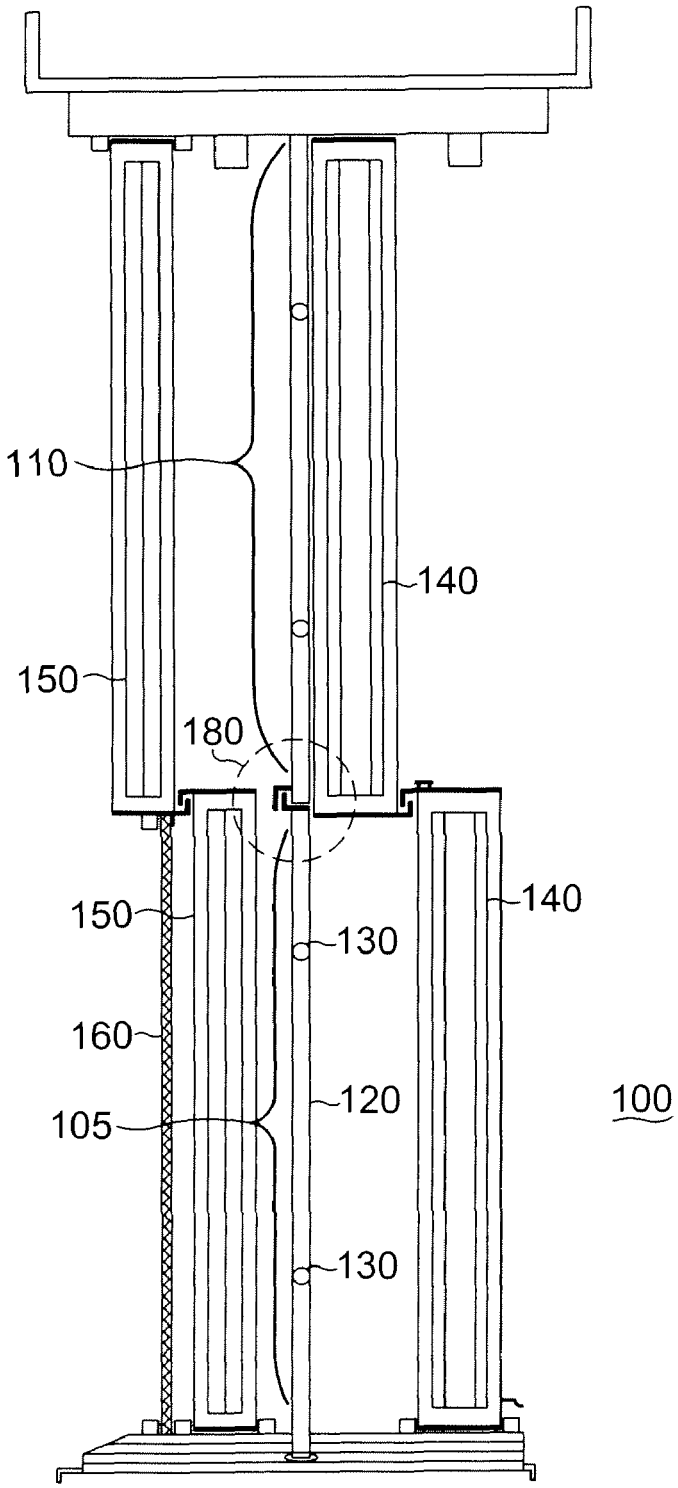
FIG. 1 shows a side view of a removable security structure interposed between two sash windows according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

A removable security structure interposed between two sash windows is hereafter described. Embodiments of the present invention include a security structure comprised of a plurality of interconnected horizontal and vertical members. The structure is coupled to a frame anchored to the dwelling. Upon rotation of at least one of the vertical members, the horizontal members are decoupled from the frame enabling the security structure to translate vertically and inwardly so as to be removed from the frame.

Specific embodiments of the present invention are hereafter described in detail with reference to the accompanying Figures. Like elements in the various Figures are identified by like reference numerals for consistency. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

1 FIG. 1 shows a side view of one embodiment of a removable security structure 100 interposed between two sash windows 140, 150, according to one embodiment of the present invention. The security structure is, in this exemplary rendition, comprised of a lower security structure 105 and an upper security structure 110. The mating or juncture 180 of the upper security structure 110 to the lower security structure 105 is shown and described in more detail in FIG. 4 and related text.

The security structure 100 is interposed between an exterior sash window 150 and an interior sash window 140. Also shown in FIG. 1 is a screen 160 or similar device to allow filtered airflow through the opening when the window is open. A sash window or hung sash window is made of one or more movable panels or "sashes" that form a frame to hold panes of glass which are often separated from other panes (or "lights") by narrow bars. Although any window with this style of glazing is technically "a sash", the term is used almost exclusively to refer to windows where the glazed panels are opened by sliding vertically or horizontally. Sash windows are common in Europe, the United States and many developing nations.

To facilitate operation, the weight of the glazed panel is usually balanced by a counter-weight concealed within the window frame. This is connected to the window by a sash cord or chain which runs over a pulley at the top of the frame, although spring balances are sometimes used. Sash windows may be fitted with simple hinges or the like that allow the window to be locked into hinges on one side while the counterbalance on the other site is detached, allowing the window to be opened for escape or cleaning. This includes, as is subsequently described, an interior sash that possesses tilt-in or awning features.

A double hung window refers to two sashes that can move up and down in the window frame. A single hung window has two sashes but normally the top sash is fixed and only the bottom sash slides. Triple and quadruple hung sash windows are used for tall openings, common in New England churches. While the present description is versed using sash windows as described above, one skilled in the art will appreciate that the invention is described by way of example and that other window designs, and indeed opening coverings, can be utilized with the present invention without departing from the invention's scope and intent. Furthermore, the present invention can be implemented using existing tilt in (or the like) window systems. The security structure 105 can be installed to the exterior of the window maintaining the functionality and versatility of the system without imparting the need to replace an existing window structure.

Figure 2A:
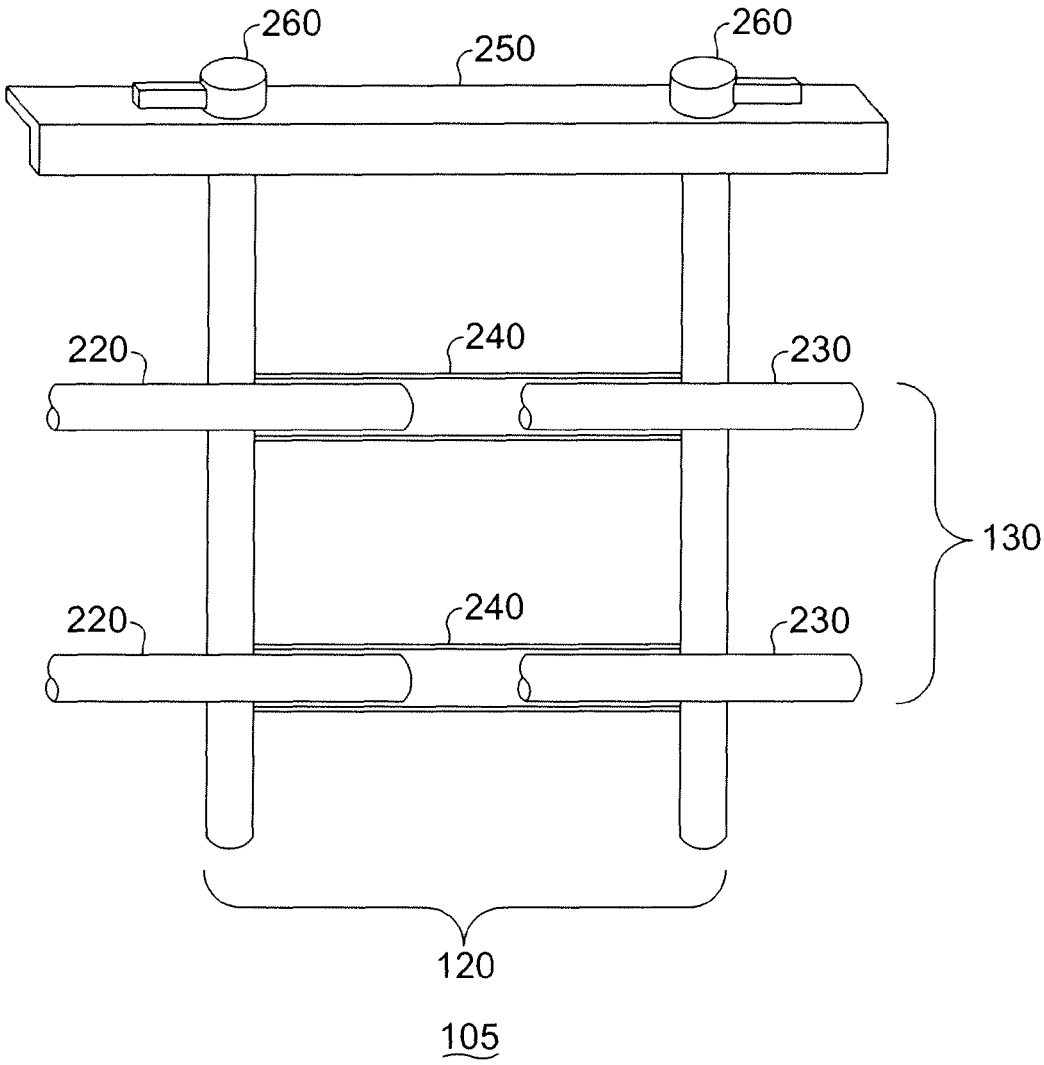
FIG. 2A shows a front view of a security structure including a plurality of horizontal and vertical members according to one embodiment of the present invention.

The lower security structure 105 includes a plurality of vertical members 120 and a plurality of horizontal members 130 as can be seen in more detail in FIG. 2. FIG. 2A is a front view of one embodiment of a lower security structure 105 of the present invention. According to one embodiment of the present invention, each horizontal member 130 is comprised of a first sub-member 220, a second sub-member 230 and an interconnecting sleeve 240. Each sub-member 220, 230 is of a dimension so that the combined length of the first and second sub-members 220, 230 is less than that of the opening. Each sub-member also possesses an exterior diameter or width that is sufficiently less than that of the internal diameter of the sleeve 240 so as to allow each sub-member to freely travel within the sleeve. Furthermore, the length of the sleeve 240 with respect to the portions of the sub-members 220, 230 is of sufficient length so as to prevent buckling at the extended most position.

As the security structure is envisioned to enhance protection from unwanted intrusion, the members and components that comprise the security structure and the frame are ideally constructed of a material that is resistant to devices or techniques that would act to cut or damage the security structure. Hardened steel, Kevlar and other material are possible options, but as one skilled in the art will recognize, a variety of material consistent with this disclosure may be used without departing from the scope and intent of the present invention.

Each vertical member 120 shown in FIG. 2A interconnects with each horizontal member 130. According to one embodiment of the present invention, each vertical member 120 also transverses a vertical support member 250. As will be subsequently described, the vertical support member 250 maintains the configuration of the lower security structure 105 upon removal from the opening. Each vertical member 120 also includes, according to one embodiment of the present invention, a lever 260 fixed to the vertical member 120 and operable to rotate the member.

Figure 2B:
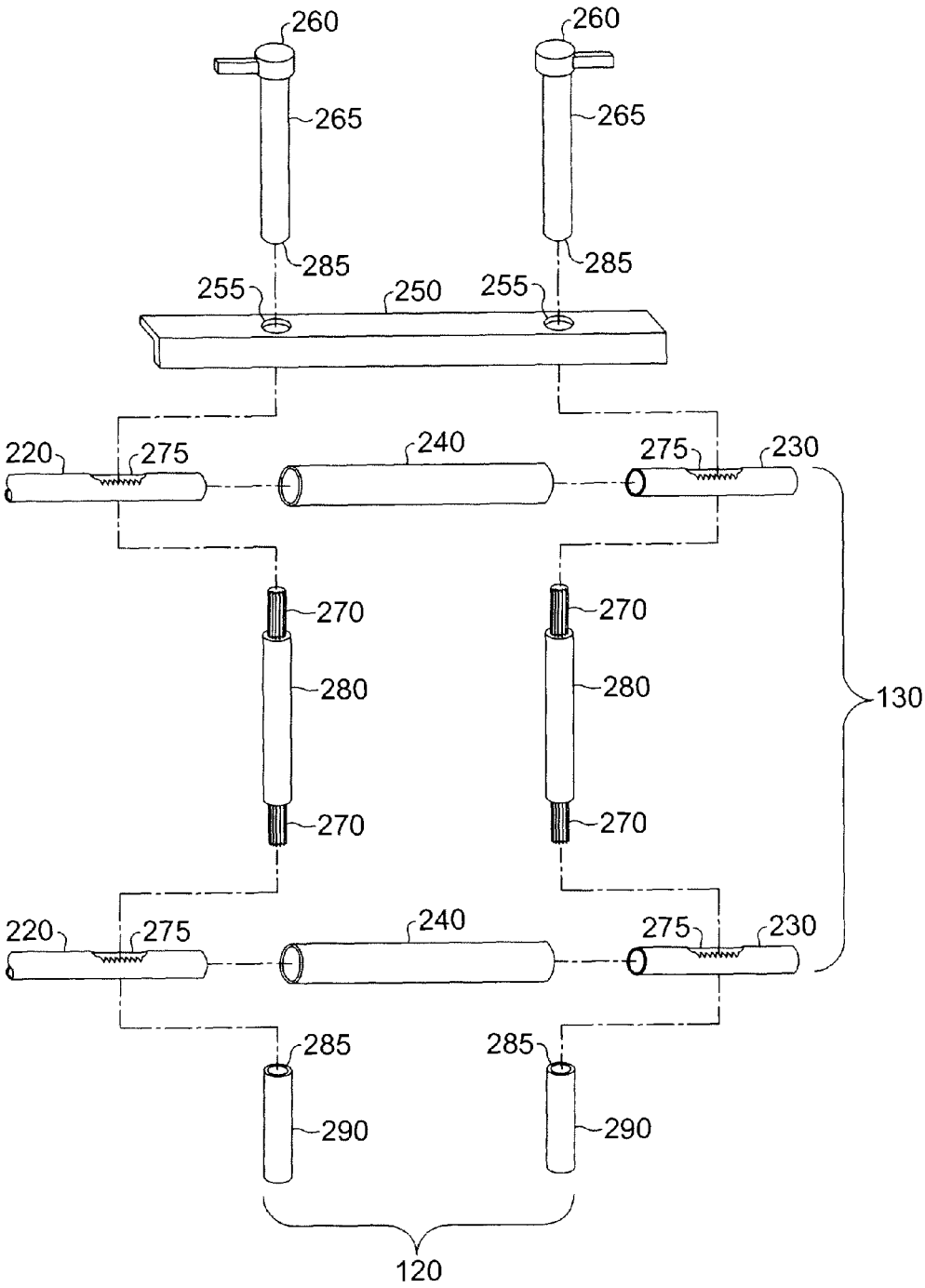
FIG. 2B shows an exploded front view of the security structure of FIG. 2A having a plurality of horizontal and vertical members according to one embodiment of the present invention.

With additional reference to FIG. 2B it can be seen that each vertical member is also comprised of sub-members. FIG. 2B shows an exploded front view of the lower security structure 105 of FIG. 2A according to one embodiment of the present invention. Each vertical member 120 in this exemplary embodiment includes an upper component 265 to which the lever 260 is attached, a mid-component 280 and a lower component 290. As one skilled in the relevant art will appreciate, the present depiction and description of two vertical members 120 and two horizontal members 130 can be altered without departing from the scope and intent of the present invention. As the number of members increases so, too, will the number of components and sub-members. Additionally, not all of the functional relationships between the components must remain as depicted to maintain the overall functional implementation of the lower security structure 105.

As shown, the mid-component 280 of each vertical member 120 is configured to have two geared ends 270 having a maximum diameter less than that of the external diameter of the vertical member 120. Each geared end is accepted into a hole 285 configured with an opposing set of teeth/gears of similar diameter to that of the geared ends 270. Thus the upper geared end 270 of the vertical mid-component 280 is received into the geared hole 285 in the upper vertical component 265, and the lower geared end 270 of the vertical mid-component 280 is received into the geared hole 285 of the lower vertical component 290.

Figure 2C:
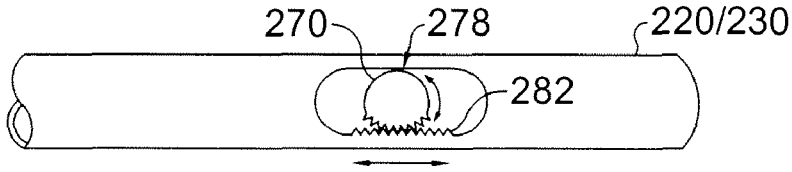
FIG. 2C shows and expanded view of a gearing design for interconnecting the vertical and horizontal members of the security structure of FIG. 2A according to one embodiment of the present invention.

Referring now in addition to FIG. 2C it can be seen that the geared end 270 of each mid-component 280 traverses an opening 275 in the sub-members 220, 230 of each horizontal member 130. As can be seen in the expanded view of the opening 275, the geared portion of the vertical mid-component 280 is, in one embodiment of the present invention, geared on only a portion of the surface. The remaining portion is smooth 278. In addition, the opening 275 in the sub-member 220, 230 is elongated with a receiving geared portion 282 configured to mesh with the geared portion of the geared ends 270 of the vertical mid-component.

As the horizontal sub-members are not fixed in either the frame or the sleeve 240, a rotation of the vertical member 120 will result in the geared portion of the geared ends 270 of the mid-component engaging the receiving geared portion 282 of the sub-member 220, 230 causing the sub-member to translate consistent with the direction of rotation. Thus, as shown, a clockwise rotation of the leftmost vertical member 120 will result in the horizontal sub-member 220 extending away from the sleeve and engaging the frame. Conversely, a counter clockwise rotation of the leftmost vertical member 120 will result in the horizontal sub-member 220 retracting from the frame and extending into the sleeve. Similarly, a clockwise rotation of the rightmost vertical member 120 will also result in the horizontal sub-member 230 retracting from the frame and a counter clockwise rotation of the rightmost vertical member 120 will resulting the horizontal sub-member 230 engaging the frame. In such a manner, rotation of the vertical members 120 can retract the horizontal sub-members 220, 230 from the frame so as to enable removal of the security structure 105.

These and other implementation methodologies for converting rotation of one component into translation of a different component can be successfully utilized by the present invention. These implementation methodologies are known within the art and the specifics of their application within the context of the present invention will be readily apparent to one of ordinary skill in the relevant art in light of this specification. For example and according to another embodiment of the present invention, springs can be used to assert a positive force on the vertical/horizontal member interaction to ensure the sub-members stay engaged within the frame until rotation or release of the springs is initiated.

Figure 3:
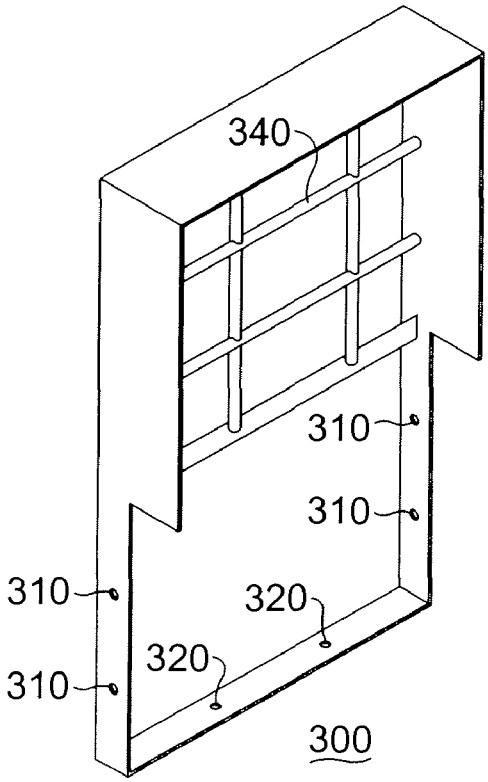
FIG. 3 shows one embodiment of a security frame configured to accept a security structure according to the present invention.

FIG. 3 shows a perspective view of one embodiment of a security frame configured to accept the security structure of the present invention. The frame 300 can be part of a modular window design or installed in a dwelling separately. The frame 300 in one embodiment comprises a plurality of sockets 310, 320 configured to receive the ends of the horizontal and vertical security members respectively. FIG. 3 also illustrate that in one embodiment the upper portion 110 of the security structure 100 is fixed and is not removable. While not shown, other embodiments of the present invention include a duplication of the removal system described above making both the upper and lower security structures removable.

Figure 4:
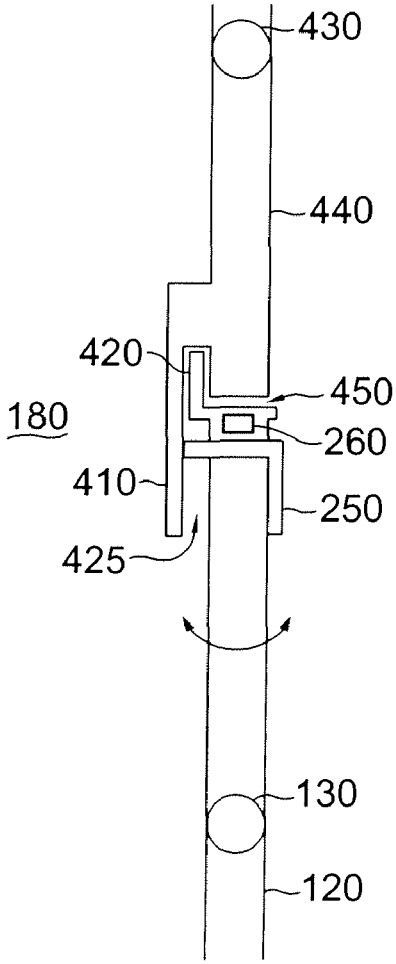
FIG. 4 shows a detailed side view of the interaction with an upper vertical member and a lower vertical member according to one embodiment of the present invention.

FIG. 4 shows a detailed side view of the interaction with an upper vertical member and a lower vertical member first shown in FIG. 1 according to one embodiment of the present invention. The junction 180 of the upper security structure 110 and the lower security structure 105 shows a tongue and groove type of assembly. Specifically the lower security structure 105 comprising vertical members 120 and horizontal members 130 includes a vertical support member 250 that spans the opening but is not coupled to the frame. Note that the rotational lever 260 is positioned above the vertical support member 250. In addition, each vertical member 120 includes a vertically orientated and offset extension 410.

As shown in FIG. 4, the vertical extension 420 of the vertical member 120 of the lower security structure 105 slides into the channel 425 created by a similar vertically orientated and slightly offset extension 410 from the vertical member 440 of the upper security structure 110. Note that the channel 425 is formed by an interaction between the offset extension 410 and the vertical support member 250. Furthermore, the interaction between the vertical extension 420 and the lower extension 410 prevents lateral movement as well as vertical travel. Horizontal movement (i.e. in and out of the paper) is prevented by the interaction between the vertical members 120, 440 and the horizontal members 130, 430.

As was previously described, one or more of the lower vertical members 120 is configured to rotate via use of the rotate lever 260 affixed to the top of the vertical member 120. Upon rotation of the vertical member 120, the lower horizontal members 130 disengage from the frame by telescopically collapsing (i.e. shortening their length). The rotation of the vertical member 120 also rotates the vertical extension 420 from out of the channel 425 and out of the confines of the lower extension 410. In doing so, vertical movement of the lower vertical member 120 is no longer constrained. According to another embodiment of the present invention the vertical extension 420 is an integral part of the rotate lever 260 such that rotation of the lever immediate disengages the vertical extension 420 from the channel 425.

Also shown in FIG. 4 is a gap 450 between the upper vertical member 440 and the lower vertical member 120. Once the lower vertical member 120 is rotated and the lower extension 410 is removed from the channel 425, the lower vertical member 120 is free to travel vertically into this gap 450. According to one embodiment of the present invention, the lower end of each lower member 120 rests in a receiving socket 320 in the frame 300. With the horizontal members 130 disengaged from the frame 300 and the vertical members 120 rotated, the vertical members 120, and indeed the entire lower security structure 105 can be lifted to disengage the ends of the vertical members 120 from the lower portion of the frame 300. Once the lower portions of the vertical members 120 are disengaged from the frame 300 the entire lower security structure 105 can be removed from the opening. Alternatively, the upper portion of the lower security structure 105 can be lowered (rotated) from the opening and removed with minimal damage or impingement to the lower frame sockets 320. Note that the lower extension 410 and the vertical support member 250 protect the vertical extension 420 and the rotate lever 260 from tampering.

Figure 5:
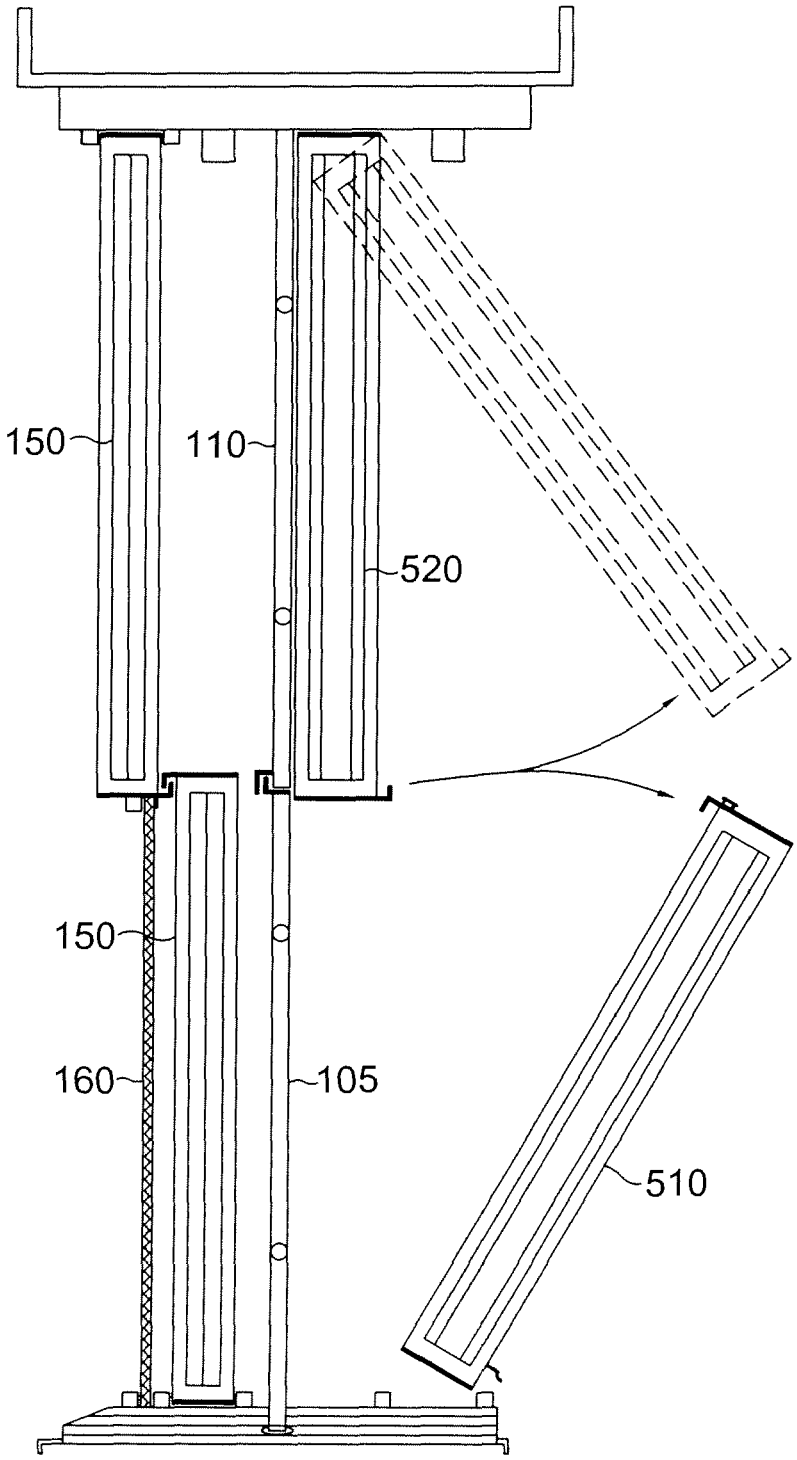
FIG. 5 is a side view of one embodiment of a removable security structure of the present invention interposed between two sash windows showing the removal of the interior sash window components.

FIG. 5 is a side view of one embodiment of a removable security structure of the present invention interposed between two sash windows showing the removal of the interior sash window components. As previously described, the upper and lower security structures 110, 105 are interposed between an external sash window/screen 150/160 and an interior sash window 140. As shown in FIG. 5, the interior sash window 140 is comprised of two or more sliding components, here an upper window 520 and a lower window 510. In normal operation and according to one embodiment of the present invention, the lower sash travels vertically along the window frame. In another version of the present invention both the upper and lower sash windows can travel vertically along the frame. And according to another embodiment of the present invention, the interior and exterior sash windows 140, 150 are linked such that the operation of the interior sash window 140 is mimicked by that of the exterior sash window 150. In addition and according to another embodiment of the present invention, the lower interior window 510 and the upper interior window 520 rotate away from the upper and lower security structures 110, 105. Significantly the rotation of the upper and lower interior windows 520, 510 enable access to the juncture 180 of the upper security structure 110 and the lower security structure 105.

As can be appreciated by viewing both FIG. 1 and FIG. 5, when the window sashes are closed, the juncture 180 of the upper security structure 110 and the lower security structure 105 is at the same level as the lower portions of the upper sash and the upper portions of the lower sash. This feature conceals the functionality of the juncture 180 from the exterior. Indeed, the upper portion of the interior sash window 510 is always in close proximity to the juncture 180. This close proximity physically prevents the rotational lever 260 from rotating the lower vertical members 120.

To rotate the vertical members 120 as previously described, the interior upper window sash 520 must, at a minimum, be rotated away from the juncture 180. To accomplish the rotation of the upper window sash 520, the lower interior window sash 510 also must be rotated away from the juncture 180.

According to one embodiment of the present invention, to remove the lower security structure 105 from the window frame 300, a four step process is required. First the lower portion of the interior sash window 510 is rotated away from the window frame and optionally removed. Second, the upper portion of the interior sash window 520 is rotated away from the window frame and optionally removed. These two steps provide access to the juncture 180 of the upper and lower security structures 110, 105.

Next, one or more of the vertical members 120 is rotated via the rotational lever 260. This process removes the vertical extension of the lower vertical members 120 interacting with the extension and channel 410, 425 from the upper vertical members 440 and disengages the horizontal members 130 from the frame by telescopically collapsing the member. Finally, the lower security structure 105 is lifted and/or rotated out of the opening providing free access to the exterior and an unimpeded avenue for egress.

Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

While there have been described above the principles of the present invention in conjunction with a removable security structure, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom,

I claim:

1. A security structure comprising:

an interior sash window;

an exterior sash window;

a window frame housing the interior sash window and the exterior sash window;

a plurality of vertical security members interposed between the interior sash window and the exterior sash window, at least one of the vertical security members is removably coupled to the window frame; and a plurality of horizontal security members interposed between the interior sash window and the exterior sash window, at least one of the horizontal security members is removably coupled to the window frame;

wherein at least one of the vertical security members further comprises a lever for rotation thereof about its longitudinal axis, and wherein the rotatable one of the vertical security members cooperates with one of the horizontal security members and responsive to rotation of the rotatable one of the vertical security members about its longitudinal axis the one of the horizontal security members telescopically retracts from the window frame; and wherein a horizontal plane intersects a portion of the exterior sash window, a portion of at least one of the vertical security members, one of the horizontal security members, and a portion of the interior sash window.

2. The security structure of claim 1, wherein the interior sash window prevents rotation of the rotatable one of the vertical security members when the interior sash window is housed within the window frame.

3. The security structure of claim 2, wherein lever is accessible and operable for rotating said rotatable one of the vertical security members about its longitudinal axis when the interior sash window is moved within the window frame away from said exterior sash window.

4. The security structure of claim 3, wherein the interior sash window tilts to permit access to the lever.

5. The security structure of claim 4, wherein the interior sash window prevents removal of the vertical security members and the horizontal security members when the interior sash window is housed within the window frame.

6. The security structure of claim 5, wherein the vertical security members and the horizontal security members are removable from the window frame to permit egress when the interior sash window is removed from the window frame.

7. The security structure of claim 5, wherein the vertical security members and the horizontal security members are removable from the window frame to permit egress when the interior sash window is tilted away from the exterior sash window.

8. The security structure of claim 1, wherein one end of one of the vertical security members is removably coupled to the window frame via a receiving socket in the window frame.

9. The security structure of claim 1, wherein the window frame comprises a horizontal cross member configured to removably couple one of the vertical security members to the window frame.

10. The security structure of claim 1 wherein the lever is inaccessible from the exterior sash window.

11. The security structure of claim 1, wherein the one of the horizontal security members comprises a first end and a second end and wherein said first end and said second end are extendable into opposing receiving sockets in the window frame.

12. The security structure of claim 11, wherein rotation of the lever retracts at least one of the first end and the second end of the one of the horizontal security members from a respective one of the receiving sockets in the window frame.

* * * * *